US011088490B2

(12) United States Patent
Hobmaier et al.

(10) Patent No.: US 11,088,490 B2
(45) Date of Patent: Aug. 10, 2021

(54) MULTI-LOCK COUNTER CONNECTOR

(71) Applicant: ODU GmbH & Co. KG, Mühldorf a. Inn (DE)

(72) Inventors: Christian Hobmaier, Niedertaufkirchen (DE); Josef Weigand, Heldenstein (DE); Günter Rohr, Schwindegg (DE)

(73) Assignee: ODU GmbH & Co. KG, Muehldorf a. Inn (DE)

( * ) Notice: Subject to any disclaimer, the term of this patent is extended or adjusted under 35 U.S.C. 154(b) by 0 days.

(21) Appl. No.: 17/012,134

(22) Filed: Sep. 4, 2020

(65) Prior Publication Data

US 2021/0075156 A1 Mar. 11, 2021

(30) Foreign Application Priority Data

Sep. 6, 2019 (EP) ..... 19196034

(51) Int. Cl.
*H01R 13/622* (2006.01)
*H01R 13/627* (2006.01)

(52) U.S. Cl.
CPC ..... *H01R 13/6271* (2013.01); *H01R 13/622* (2013.01)

(58) Field of Classification Search
CPC ..... H01R 13/622; H01R 13/6271; H01R 13/6276; H01R 13/635; H01R 13/62927
See application file for complete search history.

(56) References Cited

U.S. PATENT DOCUMENTS 3,160,457 A 12/1964 Fischer
3,319,213 A * 5/1967 Mas ..... H01R 13/6276 439/348

(Continued)

FOREIGN PATENT DOCUMENTS

CH 364543 A 9/1962
CN 108336548 A 7/2018

(Continued)

*Primary Examiner* — Tho D Ta
(74) *Attorney, Agent, or Firm* — W & C IP

(57) ABSTRACT

A counter connector for mating with a connector has a hollow cylindrical housing. The counter connector includes at least two, and preferably three, of the following three types of locking means for locking the counter connector to the connector: (A) one that is arranged on a perimeter on a cylindrical surface of the housing or of a sleeve located inside the housing, a counter engagement part in the form of a groove, a collar, or a series of radially extending apertures, recesses or protrusions, the counter engagement part being adapted to engage with at least one engagement part or at least one latching part of the connector. (B) one that has a counter latching part that can be deflected elastically in a radial direction of the counter connector and comprises at least one of a radially extending groove, collar, aperture, recess or protrusion adapted to engage with a latching part of the connector. (C) one where a counter thread is adapted to engage with a thread of the connector. Systems can include the counter connector and at least one connector that can be mated with the counter connector, wherein the connector is of one of the following three types: a) a push-pull connector; b) a break-away connector; and c) a threaded connector.

13 Claims, 4 Drawing Sheets

(56) References Cited

U.S. PATENT DOCUMENTS

| | | | | |
|---|---|---|---|---|
| 3,888,559 | A * | 6/1975 | Geib | H01R 13/635 439/258 |
| 5,752,847 | A * | 5/1998 | McCormick | H01R 13/635 439/310 |
| 6,514,096 | B1 * | 2/2003 | Liu | H01R 13/5219 439/320 |
| 8,585,424 | B2 * | 11/2013 | Montena | H01R 12/70 439/320 |
| 8,708,732 | B2 * | 4/2014 | Toda | H01R 13/6271 439/352 |
| 8,764,473 | B2 | 7/2014 | Komatsubara | |
| 2008/0032533 | A1 | 10/2008 | Suwalski et al. | |
| 2014/0368069 | A1 | 12/2014 | Ren | |
| 2020/0021055 | A1 * | 1/2020 | Wu | H01R 13/622 |

FOREIGN PATENT DOCUMENTS

| | | | |
|---|---|---|---|
| EP | 1755197 | B1 | 2/2007 |
| EP | 2779322 | A1 | 9/2010 |
| EP | 2476167 | B1 | 7/2012 |
| EP | 2548272 | B1 | 1/2013 |
| RU | 149972 | U1 | 1/2015 |
| RU | 2569317 | C2 | 11/2015 |
| RU | 2667090 | C2 | 9/2018 |

* cited by examiner

MULTI-LOCK COUNTER CONNECTOR

FIELD OF THE INVENTION

The invention relates to a counter connector for mating with a connector. The invention also relates to a system comprising the counter connector and at least one connector.

BACKGROUND OF THE INVENTION

There are numerous applications where it is necessary or desirable that a connection, eg for power supply or data transfer, is not inadvertently interrupted. Examples are medical monitoring devices to which a patient is connected for status monitoring or portable computers connected to a main computer for data exchange. Interruption of power supply or data flow can cause serious problems and damage. For critical applications, it is therefore reasonable to use connections with locking systems suitable to prevent that a connection, eg, for an electrical cable or data cable, disconnects, eg, caused by the cable's weight or because it is pulled on the cable.

Conversely, it may also be desirable or necessary that a connection disconnects itself when a certain force is applied to the connection, eg, to avoid damages of connected devices which could fall to the ground if it is pulled too strong on the cable. An example are medical devices that are connected to a patient lying on a rollaway bed. Here, a risk exists that when moving the rollaway bed and when a connection is accidentally not disconnected that the connected device falls to the ground and is damaged.

Numerous solutions for connections with locking mechanisms are known in the art. Some often-used locking mechanisms are the so-called push-pull locking mechanisms, break-away locking mechanisms, and thread-based locking mechanisms.

Each of the known mechanisms rely on a pair of connector and matching counter connector that are specifically designed to cooperate in a way that yields the desired type of locking mechanism.

For example, in a push-pull mechanism, a connector has an outer housing which an operator can grip to mate the connector with and lock it to a counter connector. The locking keeps the connector securely joined to the counter connector even if one pulls on the cable or apparatus that is provided with the push-pull connector. Yet, if the operator pulls on the outer housing, the connectors unlock and can be separated. To achieve this function, the outer housing typically is movable in the longitudinal direction relatively to an inner housing of the connector and operates the locking mechanism. One example of such locking mechanism, is referred to in the following as a LP-type locking mechanism, and a connector employing this mechanism is referred to as an LP-type connector. An LP-type connector comprises as an engagement part claws applied on elastic locking fingers of the connector. The locking fingers can engage the counter connector's counter engagement part, which can for example be a groove. The connector moreover comprises a sleeve that is movable, by means of moving the outer housing, in the longitudinal direction relatively to the fastening part of the connector so that its bends the finger away from the locking groove for unlocking. An example of an LP-type connector is disclosed in EP 1755197 B1.

Another push-pull mechanism is in the following referred to as FP-type locking mechanism, and a connector employing this mechanism is referred to as an FP-type connector. An FP-type connector comprises as an engagement part claws that can engage the counter connector's counter engagement part, which can for example be a groove. For locking, the claws are jammed between the counter engagement part of the counter connector and a conical sleeve of the connector, which is rigidly attached to the fastening part of the connector. The claws are movable, by means of moving the outer housing, in the longitudinal direction relatively to the fastening part of the connector. For unlocking, the locking fingers, operated by the outer housing, move the conical sleeve out of their way, thereby freeing themselves from the locking groove. An example of an FP-type connector is known is from CH 364543.

A third type of push-pull mechanism uses a ball-lock mechanism, as for example disclosed in U.S. Pat. No. 8,764,473 B2. Here, for locking an engagement ball of the connector is held by an elastic member in engagement with the groove of the counter connector. For unlocking, the outer housing removes the elastic member from the engagement ball, thereby allowing the locking ball to disengage from the locking groove.

Break-away mechanisms, also referred to as tear-off mechanisms, provide for an emergency unlocking function which means that the connection may be released also by pulling on the cable in the case of need. In one break-away locking mechanism, locking fingers of the connector engage with the groove provided in the counter connector to form a reliable connection between connector and counter connector. Due to a tapered or chamfered geometry of the locking fingers, breaking-away or tearing-off of the connector is guaranteed as soon as a defined pulling force applied to the connector or the cable is exceeded.

Another break-away locking mechanism having a snap-ring design works roughly like the snap-on fastener on an article of apparel, with the connector clicking in, holding securely and sliding back out over the connector only when appropriate force is exerted. Other break-away locking systems use one or several O-rings in connectors to achieve the desired range of break-away-force based on friction. The O-rings are usually wrapped around grooves machined into the housing of the connector. Canted coil springs are deployed similarly, designed into the housings of the connectors to provide the desired break-away force. Examples for break-away locking systems are disclosed in EP 2476167 B1, EP 2548272 B1, EP 2779322 A1, and US 20080032533 A1.

Thread-based locking mechanisms, as the name suggests, use a connector with a thread adapted to engage with a counter thread of a counter connector. Alternatively, the thread may be adapted to fit into a counter thread of a coupling nut with which the connector or counter connector is provided.

Object of the Invention

It is an object of the present invention to provide an improved counter connector for mating with a connector. In particular, the invention aims at providing a counter connector compatible with connectors with multiple types of locking systems, such as push-pull, break-away and thread-based locking systems. It is another object of the present invention to provide an improved system comprising the counter connector and at least one connector.

Solution According to the Invention

The reference numerals in the patent claims are not meant to be limiting but merely serve to improve the readability of the claims. In the context of the present invention, any reference to one (including the articles "a" and "the"), two or another number of objects is, provided nothing else is expressly mentioned, meant to be understood as not excluding the presence of further such objects in the invention.

According to one aspect of the invention, the problem is solved by a counter connector for mating with a connector, the counter connector comprising the features of claim 1. The counter connector has a hollow cylindrical housing and comprises at least two, preferably three, of the following three types of locking means for locking the counter connector to the connector:

a) Arranged on a perimeter on the cylindrical surface of a housing of the counter connector or of a sleeve located inside the housing, a counter engagement part in the form of a groove, a collar, or a series of radially extending apertures, recesses or protrusions, the counter engagement part being adapted to engage with at least one engagement part or at least one latching part of the connector;

b) A counter latching part that can be deflected elastically in a radial direction of the counter connector and comprises at least one of a radially extending groove, collar, aperture, recess or protrusion adapted to engage with a latching part of the connector; and c) A counter thread adapted to engage with a thread of the connector.

It is an achievable advantage of this connector that due to the multiple types of locking means it can be used with multiple types of locking systems, for example two or more of the group comprising push-pull, break-away and thread-based locking systems. This can increase the range of suitable applications of the counter connector. It can advance standardization, improve convenience and entail cost savings.

In the context of the present invention, the term "cylindrical" refers to the shape of a general cylinder. The cross-section of the general cylinder is not necessarily circular but can have the shape of any closed planar curve, for example ovoid, including elliptical, or rectangular, including square. Yet, the preferred housing has a circular cross-section and, accordingly, the preferred counter connector is a round counter connector. Both, the inner cylindrical surface and the outer cylindrical surface of the housing are "cylindrical surfaces" within the meaning of the present invention. Thus, for example, a groove arranged on the perimeter of a cylindrical surface of the housing can be arranged either on the inner or on the outer cylindrical surface of the housing.

That the latching part can be deflected elastically means that an elasticity either is intrinsic to or acts on the latching part. When reference is made to a "radial direction" with regard to the counter connector or the connector, this is relative to the longitudinal axis of the counter connector or connector. The term includes both the outward radial direction, which designates the direction away from the longitudinal axis, and the inward radial direction, which designates the direction towards the longitudinal axis.

According to another aspect of the invention, the problem is moreover solved by a system comprising the counter connector and at least one connector that can be mated with the counter connector, wherein the connector is of one of the following three types: a) A push-pull connector; b) a break-away connector; and c) a threaded connector.

In the context of the present invention, a push-pull connector is a connector that comprises (i) a fastening part for fixedly attaching a cable or an apparatus to the counter connector, (ii) an engagement part for engaging with the counter connector's counter engagement part to lock the counter connector to the connector, and (iii) an outer housing movable relatively to the fastening part and functionally connected to the engagement part such that in order to unlock the counter connector from the connector, the outer housing of the connector must be moved relatively to the fastening part. The fastening part can for example be a cable collet. It is typically part of or rigidly attached to an inner housing of the connector.

In the context of the present invention, a break-away connector comprises at least one latching part for engaging with the aperture, recess or protrusion of the counter latching part or the counter engagement part of the counter connector to lock the counter connector to the connector. The engagement is such that if the connector and the counter connector are pulled apart from each other by a force larger than a value defined is by the elasticity intrinsic to or acting on the latching part, the connector unlocks from the counter connector.

In the context of the present invention, a threaded connector comprises a thread for engaging with the counter thread of the counter connector to lock the counter connector to the connector. For locking, the counter thread of a connector is screwed into the thread of the counter connector.

The counter connector according to the invention can be arranged on an apparatus, for example on a front panel of the apparatus. A connector according to the invention can serve to connect a cable to an apparatus. For this purpose, the connector can be attached to the cable. Yet, the invention also includes embodiments in which the connector is arranged on the apparatus; in such embodiments, the counter connector can be attached to the cable. In other embodiments, both, the counter connector and the connector are attached to cables, or both are arranged on apparatus. The present invention encompasses counter connectors and connectors of any gender, male and female. The preferred counter connector and connector is an electrical connector.

Preferred Embodiments of the Invention

Preferred features of the invention which may be applied alone or in combination are discussed in the following and in the dependent claims.

In a preferred embodiment of the invention, the counter connector and/or the connector are round. Within the meaning of the present invention, a counter connector or connector is round, if the distal part of the housing, ie the part of the housing that is intended to mate with the counterpart, has circular cylindrical cross section. Advantageously, such (counter) connectors can easily be provided with a (counter) thread as (counter) locking means. The preferred groove or collar of the counter engagement part or the counter latching part are a full groove and a full collar, ie a grove and a collar that extends along the full perimeter of a cylindrical surface. Thus, the groove or the collar is an annular groove or an annular collar. In case of a circular cylindrical surface, the groove or the collar is an circular annular groove or an circular annular collar.

Preferably, the counter connector comprises as a locking means a groove, a collar, or a series of apertures, recesses or protrusions, arranged on a perimeter of the cylindrical surface of the connector housing, preferably an outer cylindrical surface of the connector housing. The locking means on the outer cylindrical surface are particularly suitable for engagement with the engagement balls of a connector of the ball-lock type, where the engagement balls engage the locking means of the counter connector from the outside.

In alternative embodiment the groove, the collar, or the series of apertures, recesses or protrusions are arranged on a perimeter of the inner cylindrical surface of the housing. Such embodiment is particularly suitable for mating with a LP- and FP-type push-pull connector.

If the locking means are provided on a sleeve located inside the housing, the sleeve preferably is rigidly attached to the housing of the counter connector. If the counter connector is attached to a cable, the preferred sleeve is electrically connectable to a shield and/or a ground wire of the cable.

Preferably, the counter connector comprises a counter latching part that can be deflected elastically in a radial direction of the counter connector and comprises at least one of a radially extending groove, collar, aperture, recess or protrusion adapted to engage with a latching part of the connector.

A preferred counter connector comprises as a locking means a counter latching part in the form of a tongue that can be deflected elastically in a radial direction of the connector. The preferred latching tongue is attached to a sleeve located inside the counter connector housing. The preferred sleeve is rigidly attached to the housing of the counter connector. If the counter connector is connected to a cable, the preferred sleeve is electrically connectable to a shield and/or a ground wire of the cable.

The tongue preferably extends in the distal direction of the counter connector. In the counter connector, the distal direction is the direction that extends along the longitudinal axis of the counter connector and towards the distal end of the counter connector. The counter connector's distal end is the end that is intended to face the connector for mating the counter connector with the connector. Accordingly, the counter connector's proximal end is the end that is opposite of its distal end, and the proximal direction of the counter connector is the direction that extends along the longitudinal axis of the counter connector and points towards the proximal end of the counter connector.

Preferably, the counter latching part comprises two or more tongues, for example three, four, five, six, seven, or eight tongues. These tongues preferably are formed by mean of longitudinal slits provided in the sleeve, the slits extending from the distal end of the sleeve.

In a preferred embodiment of the invention, the counter latching part comprises a helical spring to provide for elasticity. The preferred spring is bent to form a closed ring, as for example a Bal Spring (R), available from Bal Seal Engineering, Inc, 19650 Pauling, Foothill Ranch, Calif. 92610-2610, USA. The spring can for example be placed in an annular groove on a perimeter on the inner or outer cylindrical surface of the housing or of a sleeve of the counter connector. The spring preferably engages with the connector's latching part in the form of an annular groove of the connector. If the connector and the counter connector are pulled apart from each other by a force larger than a value defined by the elasticity of the spring, the spring yields and the connector unlocks from the counter connector. In place of a spring another ring-shaped elastic element, for example a rubber ring, or a Bal Seal (R), also available from Bal Seal Engineering, Inc, may be used.

In a preferred counter connector, the counter engagement part or the counter latching part is tapered or chamfered in the longitudinal direction of the counter connector. Advantageously, this can facilitate the engaging and disengaging of the counter engagement or the counter latching part with or from its corresponding engagement or latching part in the connector.

The preferred counter thread of the counter connector and/or the matching thread of the connector is a multi-start thread. It is an achievable advantage of this embodiment of the invention that the angular interval, for locking and unlocking the counter connector from the connector can be small, for example less than a full turn. The counter thread can for example be a two-, three-, four-, five or six-start thread. Preferably, the counter thread of the counter connector is likewise a multi-start-thread, for example a two-, three-, four-, five or six-start thread.

In another embodiment of the invention, the counter thread of the counter connector and/or the matching thread of the connector is a regular, ie a single-start thread. This embodiment of the invention can be of particular advantageous in small counter connectors and connectors.

The preferred counter thread of the counter connector and/or the matching thread of the connector may be trapezoidal or sharp. The counter thread of the counter connector and the matching thread of the connector may be oriented right-handed or left-handed. A right-handed thread can be advantageous since most people are right-handed and therefore can apply more torque turning clockwise than turning counter-clockwise.

Preferably, the counter thread is located on a cylindrical surface of the housing of the counter connector, preferably the outer cylindrical surface of the housing. This way, it is easily accessible for the matching thread of the connector. In an alternative embodiment of the counter connector, the counter thread is provided on the inner cylindrical surface of a coupling nut of the counter connector that is rotatably attached to the counter connector. For locking, the nut is rotated relatively to the counter connector.

The matching thread of the counter connector can be provided on a housing, preferably an inner housing, of the connector or it can be provided on the inner cylindrical surface of a coupling nut of the connector that is rotatably attached to the connector. For locking, the nut is rotated relatively to the connector.

A preferred counter connector comprises at least a counter engagement and a counter thread part as a locking means and the counter engagement part and the thread are located on the same cylindrical surface of the counter connector housing, preferably the outside.

The counter engagement part preferably is located on the distal side of the thread. If the counter engagement part is located on the outer cylindrical surface of the counter connector housing, it preferably does not extend in outward radial direction beyond the minor diameter of the thread. Likewise, if the counter engagement part is located on the inner cylindrical surface of the counter connector housing, it preferably does not extend in inward radial direction beyond the minor diameter of the thread. This way it can be avoided that the counter engagement part of the counter connector is in the way of a thread of the connector when the counter connector and the connector are mated.

Preferably, the system of a counter connector and a connector comprises the counter connector and two, more preferably three, connector(s) that can be mated with the counter connector, wherein each the connectors are of at least two, preferably all three, of the three types: a) A push-pull connector; b) a break-away connector; and c) a threaded connector.

Advantageously, with this embodiment of the invention the same counter connectors can be mated with multiple connectors. This can increase the range of suitable applications of the counter connector, advance standardization, improve convenience and entail cost savings.

A preferred push-pull connector is an LP-type connector, for example as disclosed in EP 1755197 B1. In the context of the present invention, an LP-type connector is a connector that comprises as an engagement part claws applied on elastic locking fingers of the connector. They can engage the counter connector's counter engagement part, which can for example be a groove. The connector moreover comprises a sleeve that is movable, by means of moving the outer housing, in the longitudinal direction relatively to the fastening part of the connector so that its bends the finger away from the locking groove for unlocking.

Another preferred push-pull connector is an FP-type connector, for example as disclosed in CH 364543. In the context of the present invention, an FP-type connector is a connector that comprises as an engagement part claws that can engage the counter connector's counter engagement part, which can for example be a groove. For locking, the claws are jammed between the counter engagement part of the counter connector and a conical sleeve of the connector, which is rigidly attached to the fastening part of the connector. The claws are movable, by means of moving the outer housing, in the longitudinal direction relatively to the fastening part of the connector. For unlocking, the locking fingers, operated by the outer housing, move the conical sleeve out of their way, thereby freeing themselves from the locking groove.

Yet another preferred push-pull connector is a ball-lock connector, as for example disclosed in U.S. Pat. No. 8,764,473 B2. In the context of the present invention, a ball-lock connector is a connector where for locking an engagement ball of the connector is in engagement with the groove of the counter connector. For unlocking, the engagement ball, by means of moving the outer housing, is actively removed from engagement or allowed to disengage from the counter engagement part.

A preferred break-away connector may comprise as a latching part a latching finger that can be deflected elastically in a radial direction of the counter connector. The latching part may comprise at least one of an aperture, a recess or a protrusion adapted to engage with the aperture, recess or protrusion of the counter latching part of the counter connector or with the groove, the collar, or the series of apertures, recesses or protrusions of the counter engagement part of the counter connector.

BRIEF DESCRIPTION OF THE DRAWINGS

In the following, further preferred embodiments of the invention are illustrated through examples. The invention is not limited to these examples, however.

The drawings schematically show.

DETAILED DESCRIPTION OF AN EMBODIMENT OF THE INVENTION

Figure 1:
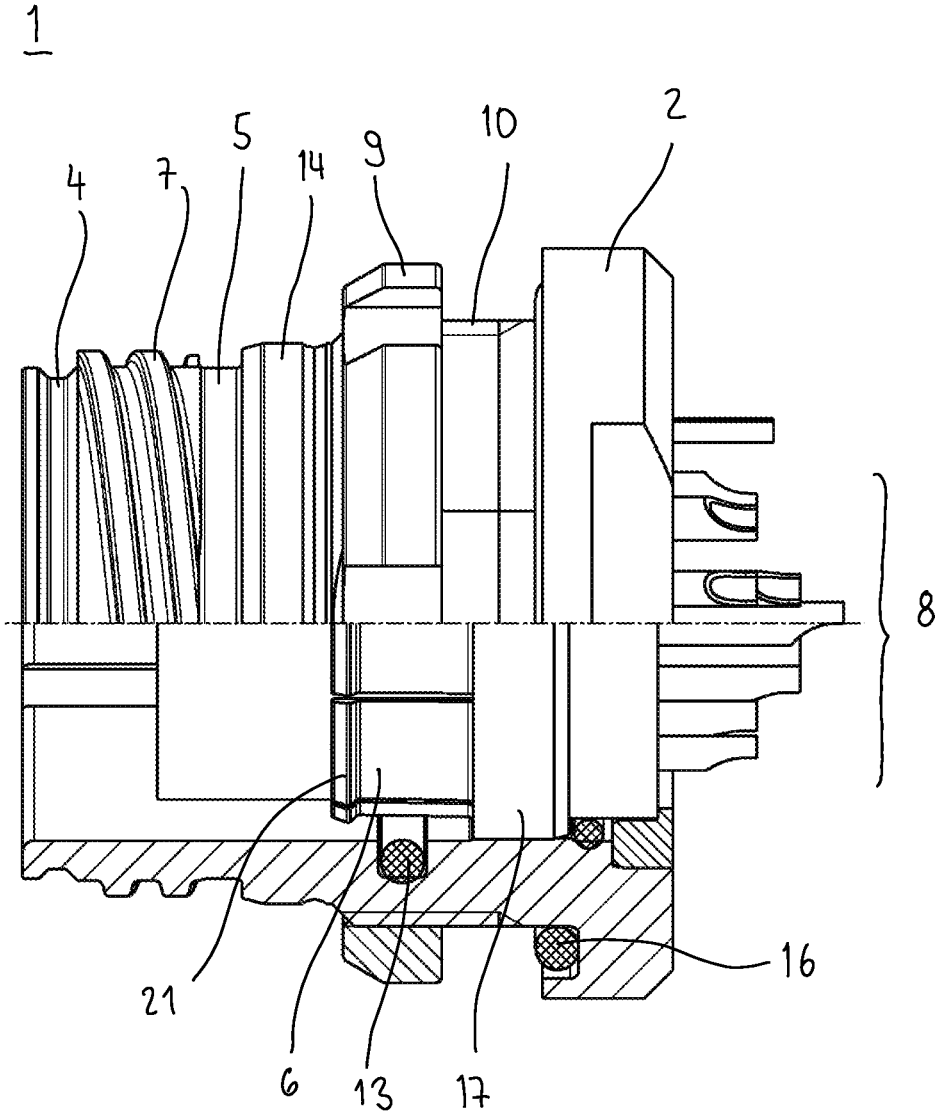
FIG. 1A cutaway drawing of a counter connector according to the invention; the upper part of figure shows the outside of the housing while in the lower part of the drawing the top part of the housing is cut away.

In the following description of preferred embodiments of the invention, identical reference numerals refer to identical or similar components.

The counter connector 1 shown in FIG. 1 comprises a hollow circular cylindrical housing 2 with three types of locking means for locking the counter connector 1 to a connector 3: a) A counter engagement part 4 in the form of a groove arranged on the perimeter on an outer cylindrical surface 5 of the housing 2 of the counter connector 1, b) A counter latching part 6 in the form of a tongue that can be deflected elastically in a radial direction of the counter connector 1, and c) A counter thread 7.

The counter connector 1 is an electrical connector and therefore comprises soldering lugs 8 for attaching leads of a cable (not shown) to the counter connector. A nut 9 that engages with a mounting thread 10 and a seal 16 of the counter connector 1 can be used to apply the counter connector 1 to the housing (not shown) of an apparatus, for example a connector panel of such apparatus housing.

Figure 2:
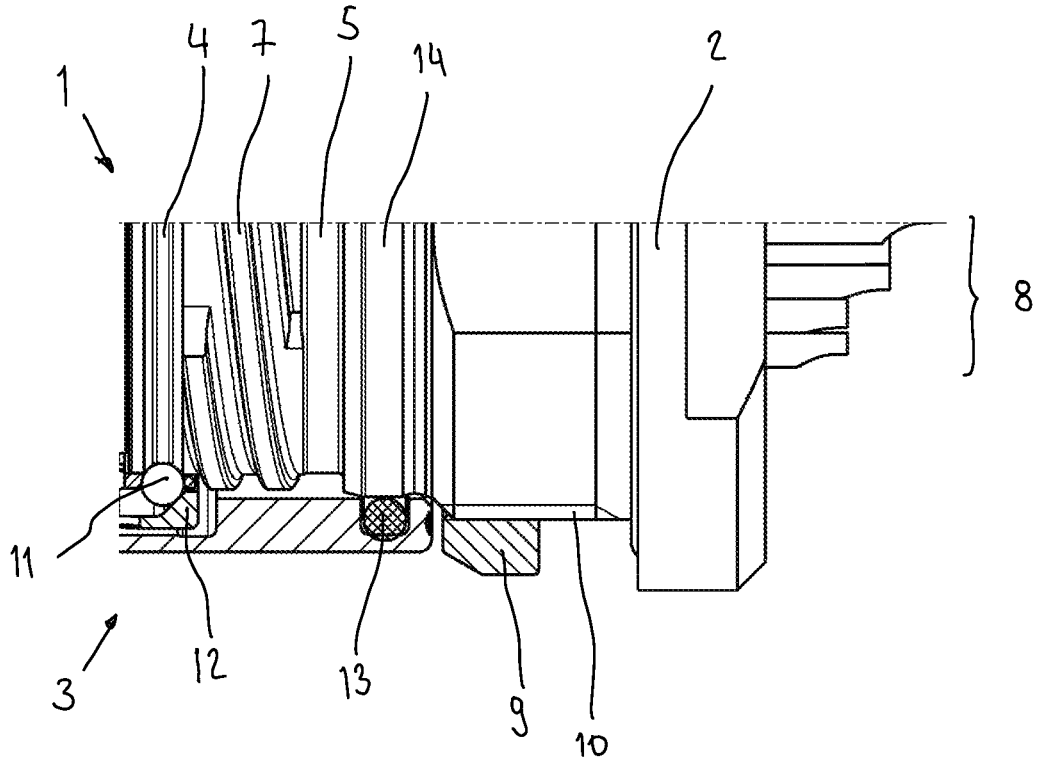
FIG. 2A cutaway cross-sectional drawing of a ball-lock connector in engagement with the counter connector according to the invention.

In FIG. 2, the counter engagement part 4 of the counter connector 1 is shown in engagement with an engagement ball 11 of a ball-lock connector 3. The counter engagement part 4 is an annular full groove with chamfered sides. The engagement ball 11 is clamped between the groove of the counter engagement part 4 and a conical support part 12 of the connector 3. Since the groove is at the distal side of the counter thread 7 also shown in FIG. 2, it is not in the way of the engagement ball 12 when the counter connector 1 and the connector 3 are mated with or removed from each other. A rubber seal ring 13 of the connector 3 engages with a sealing surface 14 of the counter connector 1 to prevent fluids and dust to enter the region between the connector 3 and the counter connector 1.

Figure 3:
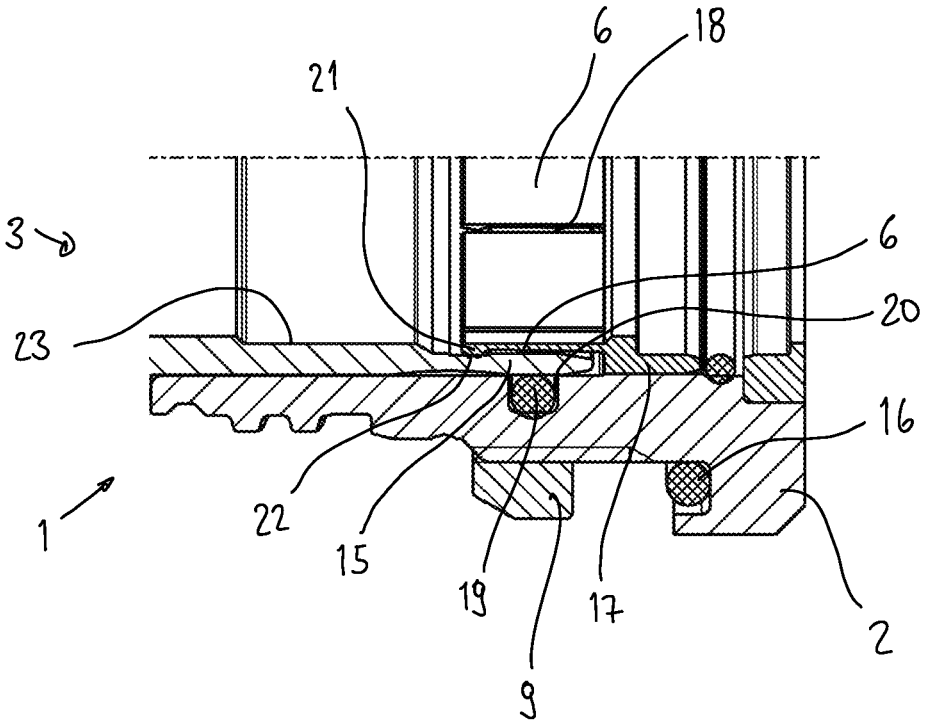
FIG. 3A cutaway cross-sectional drawing of a break-away connector in engagement with the counter connector according to the invention.

In FIG. 3, the counter latching part 6 of the counter connector 1 is shown in engagement with a latching part 15 of a break-away connector 3. The counter latching part 6 is provided in the form of multiple tongues that can be deflected elastically in a radial direction of the counter connector 1.

The tongues are attached to a sleeve 17 located inside the counter connector housing 2 and rigidly attached to this housing 2. The sleeve 17 is electrically connected (not shown) to the soldering lug 8 for the shield or a ground wire of the cable. The tongues extend in the distal direction of the counter connector and are formed by mean of longitudinal slits 18 provided in the sleeve 17, the slits 18 extending from the distal end of the sleeve 17. A rubber seal ring 19 of the counter connector 1 engages with a sealing surface 20 of the connector 3 to prevent fluids and dust to enter the region between the connector 3 and the counter connector 1.

As be best seen in FIG. 1, the ends of the tongues are provided with protrusions 21 that extend in outward radial direction. The protrusions 21 engage with a flat chamfered groove 22 in the inner cylindrical surface 23 of the connector's 3 housing. The protrusions 22 are likewise chamfered in particular on their distal side to provide for easy engagement when the counter connector 1 is locked to the connector 3. Another chamfer on the proximal side of the counter connector 1 and a corresponding chamfer the proximal side of the groove of the connector 3 together with the elasticity of the tongues and the seal ring 19 define the force required to unlock the counter connector 1 from the connector 3 by pulling the two apart from each other.

Figure 4:
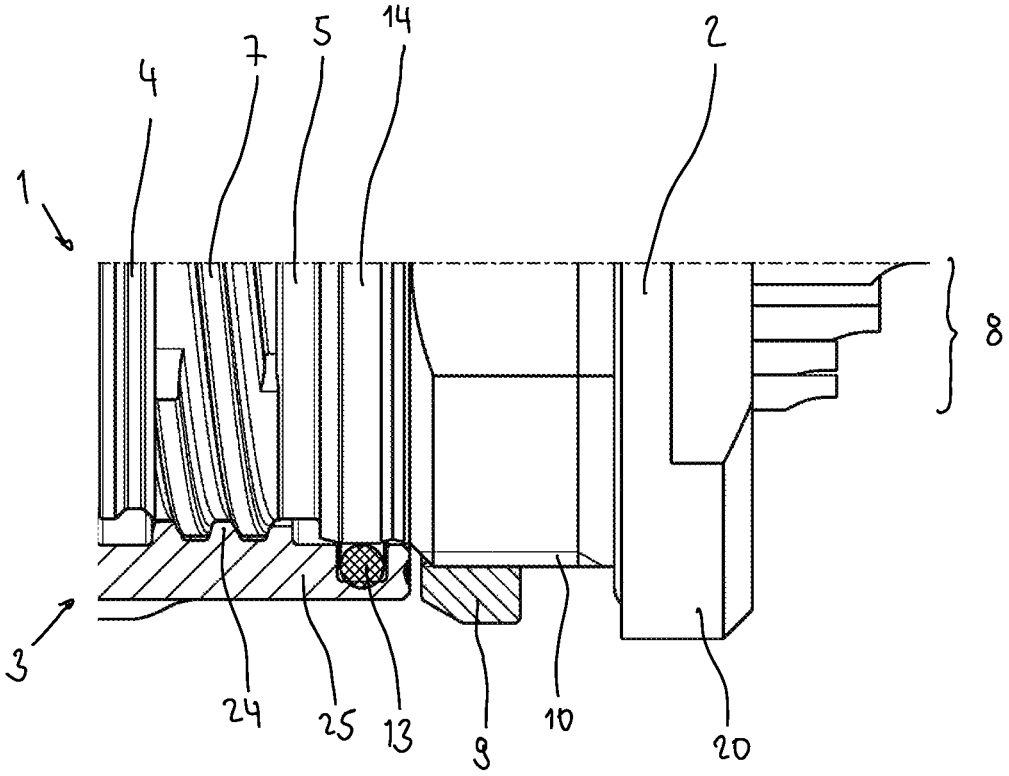
FIG. 4A cutaway cross-sectional drawing of a threaded connector in engagement with the counter connector according to the invention.

In FIG. 4, the counter thread 7 is shown in engagement with the thread 24 of a threaded connector 3. The threads 24, 7 of both the connector 3 and the counter connector 1 are three-start threads. The counter thread 7 of the counter connector 1 is located on the outer cylindrical surface of the housing 2 of the counter connector 1, which is the same surface on which the annular groove of the counter engagement part 4 is located.

The thread 24 of the connector 3 is located on an inner cylindrical surface of a nut 25 rotatably attached to the housing of the connector 3. A rubber seal ring 13 of the connector 3 engages with a sealing surface 14 of the counter connector 1 to prevent fluids and dust to enter the region between the connector 3 and the counter connector 1.

Due to the three types of locking means provided in the counter connector 1 shown in the Figures, it can be used with three types of connectors 3, namely a push-pull connector, a break-away connector and a threaded connector. The locking means are arranged on the counter connector 1 in a way that they do not interfere with each other or the corresponding locking means of the three types of connectors 3. Thereby, the counter connector 1 can increase the range of applications it can be used for. As a standard counter connector 1 for different types of connectors 3 it can advance standardization, improve convenience and entail cost savings.

The invention claimed is:

1. A counter connector for mating with a connector, comprising:

a hollow cylindrical housing; and at least the following three types of locking means for locking the counter connector to the connector:

a) arranged on a perimeter on a cylindrical surface of the housing or of a sleeve located inside the housing, a counter engagement part in the form of a groove, a collar, or a series of radially extending apertures, recesses or protrusions, the counter engagement part being adapted to engage with at least one engagement part or at least one latching part of the connector;

b) a counter latching part that can be deflected elastically in a radial direction of the counter connector and wherein the counter latching part comprises at least one of a radially extending groove, collar, aperture, recess or protrusion adapted to engage with a latching part of the connector; and c) a counter thread adapted to engage with a thread of the connector.

2. The counter connector of claim 1, having a shape that is round.

3. The counter connector of claim 1, wherein the groove, the collar, or the series of apertures, recesses or protrusions of locking means a), is arranged on a perimeter of a cylindrical surface of the housing.

4. The counter connector of claim 1, wherein the groove, the collar, or the series of apertures, recesses or protrusions forming the counter engagement part, is arranged on a perimeter of an outer cylindrical surface of the housing.

5. The counter connector of claim 1, wherein the groove, the collar, or the series of apertures, recesses or protrusions forming the counter engagement part, is arranged on a perimeter of an inner cylindrical surface of the housing.

6. The counter connector of claim 1, wherein the locking means comprises the counter engagement part or the counter latching part being tapered or chamfered in a longitudinal direction of the counter connector.

7. A system, comprising a counter connector according to claim 1, and at least one connector that can be mated with the counter connector, wherein the at least one connector is of one of the following three types: a) a push-pull connector; b) a break-away connector; and c) a threaded connector.

8. The counter connector of claim 1 wherein at least two of the three types of locking means includes all three of types a), b), and c).

9. The counter connector of claim 1, wherein the locking means comprises the counter latching part in the form of a tongue that can be deflected elastically in the radial direction of the connector.

10. The counter connector of claim 9, wherein the tongue extends in the distal direction of the counter connector.

11. The counter connector according to claim 1, wherein the locking means includes c) the counter thread, and wherein the counter thread is located on a cylindrical surface of the housing.

12. The counter connector according to claim 11, wherein the counter connector comprises at least the counter engagement part, and the counter engagement part and the counter thread are located on a same cylindrical surface of the housing.

13. The counter connector according to claim 12, wherein the counter engagement part is located on the distal side of the thread.

* * * * *